United States Patent [19]

LeBlanc, Jr.

[11] Patent Number: 4,780,342

[45] Date of Patent: Oct. 25, 1988

[54] ELECTROLESS NICKEL PLATING COMPOSITION AND METHOD FOR ITS PREPARATION AND USE

[75] Inventor: Oliver H. LeBlanc, Jr., Schenectady, N.Y.

[73] Assignee: General Electric Company, Schenectady, N.Y.

[21] Appl. No.: 75,704

[22] Filed: Jul. 20, 1987

[51] Int. Cl.[4] ..... B05D 1/18

[52] U.S. Cl. ..... 427/443.1; 106/1.22; 106/1.27

[58] Field of Search ..... 427/443.1; 106/1.22, 106/1.27

[56] References Cited

U.S. PATENT DOCUMENTS

| | | | |
|---|---|---|---|
| 2,658,842 | 11/1953 | Gutzeit | 106/1.22 |
| 3,198,659 | 8/1965 | Levy | 427/438 |
| 3,782,978 | 1/1974 | Souza | 106/1.27 |
| 3,894,847 | 7/1975 | Asano | 106/1.27 |
| 3,915,716 | 10/1975 | Haack | 106/1 |

OTHER PUBLICATIONS

Antonio Braibanti et al., "Gli anioni tris(idrazincarbossilato—N',O) metallo (II) allo stato solido e in soluzione, Ric. Sic. 36, 1966, pp. 1153–1160.

V. M. Gershov et al., *Temperature Activation of Chemical Nickel-Plating in Hydrazine Solutions,* Russian Engineering Journal, vol. 53, No. 10, pp. 73–74.

D. J. Levy, *Thin Nickel Films by Hydrazine Autocatalytic Reduction,* Electrochemical Technology, Jan.–Feb. 1963, pp. 38–42.

J. Dini et al., *Thick Nickel Deposits of High Purity by Electroless Methods,* Plating, Apr. 1967, pp. 385–390.

A. Braibanti et al., "Tris(Hydrazine Carboxylate—N,O) Metal (II) Anions in the Solid State and in Solution. I. Potassium Salts", *Ric. Sci.* 36, 1153–1155; *Chemical Abstracts:* vol. 66, 108869s (1967).

A. Braibanti et al., "Tris(Hydrazine Carboxylate—N,O) Metal (II) Anions in the Solid State and in Solution. II. Spectroscopic and Magnetic Investigation, *Ric. Sci.* 36, 1156–60 (1966); *Chemical Abstracts:* vol. 67, 58924d (1967).

*Primary Examiner*—Shrive P. Beck
*Assistant Examiner*—Vi Duong Dang
*Attorney, Agent, or Firm*—Francis T. Coppa; James C. Davis, Jr.; James Magee, Jr.

[57] ABSTRACT

An aqueous bath for the electroless plating of nickel is disclosed, in which nickel is utilized in the form of the tris(hydrazine carboxylato-$N^2$,O) nickelate(1−) complex. Methods for preparing such a bath and for plating various metal surfaces in the bath are also disclosed.

20 Claims, 1 Drawing Sheet

ELECTROLESS NICKEL PLATING COMPOSITION AND METHOD FOR ITS PREPARATION AND USE

FIELD OF THE INVENTION

This invention relates to an improved electroless nickel plating composition and to a method for applying a nickel layer to a metal surface.

BACKGROUND OF THE INVENTION

The increasing sophistication of today's semiconductor chips requires corresponding technological advancements in the packaging of such chips. Ceramic chip carriers often make use of alumina-based substrates upon which discrete areas of multilayer metallization have been bonded. Generally, the metallization comprises (a) a base metallization layer bonded to the ceramic substrate, (b) a layer of nickel bonded to the base layer, and (c) a layer of gold bonded to the nickel layer. The base metallization layer is often formed of a refractory metal such as tungsten which may be screen-printed onto the substrate surface.

The nickel layer enhances wire bonding while also providing a good thermal expansion match between the tungsten and gold layers. While this layer may be applied by either electrolytic or electroless plating techniques, electroless plating is increasingly being used because of its ability to apply very uniform layers of nickel to complex, nonplanar surfaces, such as chip carrier surfaces having patterned contact holes and vias for electrical interconnection.

In these applications, it is often desirable that the nickel films be chemically pure. Unfortunately, the most common electroless nickel plating baths known in the art, which employ hypophosphite, borohydride or amine boranes as the chemical reducing agent, all deposit nickel films that contain about 1%–15% by weight phosphorous or boron as impurities. These impurities reduce the electrical conductivity of the nickel film; make it brittle; and cause it to be a relatively inferior surface for soldering.

It is known from the prior art that pure nickel films can be deposited from electroless plating baths in which hydrazine is used as the reducing agent. An exemplary electroless nickel plating bath of this kind is disclosed in W-D Haack's U.S. Pat. No. 3,915,716, and includes hydrazine, ammonia, monoethanolamine or diphosphate as a complexing agent, and carbonates or orthophosphates to buffer the bath at a pH between 11 and 12. Furthermore, in U.S. Pat. No. 3,198,659 and in "Thin Nickel Films by Hydrazine Autocatalytic Reduction", *Electrochemical Technology,* 1, 38–42 (1963), D. J. Levy discloses nickel plating compositions which include a nickel salt, sodium hydroxide, one of several complexing agents, and hydrazine as a reducing agent. In "Thick Nickel Deposits of High Purity by Electroless Methods", *Plating,* 54, 385–390 (1967), J. Dini et al. disclose a nickel plating composition which can contain nickel acetate, glycolic acid, tetrasodium EDTA, and hydrazine. V. M. Gershov et al. disclose a nickel-plating bath containing nickel sulphate, hydrazine sulphate and monoethanolamine, in *Temperature Activation of Chemical Nickel-Plating in Hydrazine Solutions,* Russian Engineering Journal, Volume 53, No. 10, pp. 73–74.

Unfortunately, the attributes of these electroless plating compositions are accompanied by several disadvantages. For example, the use of these baths to plate refractory metals often requires activation of the metal surface, such activation generally preceded by a series of complicated, rigorous cleaning steps.

Furthermore, some of the electroless plating baths of the prior art are highly unstable under temperature conditions necessary for plating nickel onto various substrates.

Moreover, the plating rates achieved by using some of these baths is very low, less than about 3 microns per hour, even at plating temperatures as high as 95° C. Such plating rates, along with the ability to form only very thin nickel films, greatly diminishes the value of such baths in many commercial applications.

Other electroless plating compositions, such as those disclosed in the Gershov et al. reference mentioned above, are able to achieve high plating rates only when used at very high temperatures (100° C.–200° C.).

It is therefore an object of the present invention to provide a highly stable electroless nickel plating composition.

It is another object to provide a plating composition which can be used to apply chemically pure nickel to a metal substrate.

It is a further object to provide a nickel plating composition which allows nickel to be plated directly upon refractory metal surfaces without prior activation of the surfaces.

It is still another object of the present invention to provide a reliable and practical method of electrolessly applying nickel to a metal purface at high plating rates and at moderate plating bath temperatures.

Another object of the present invention is to provide a method for preparing such an electroless nickel plating composition.

DESCRIPTION OF THE INVENTION

Figure 2:
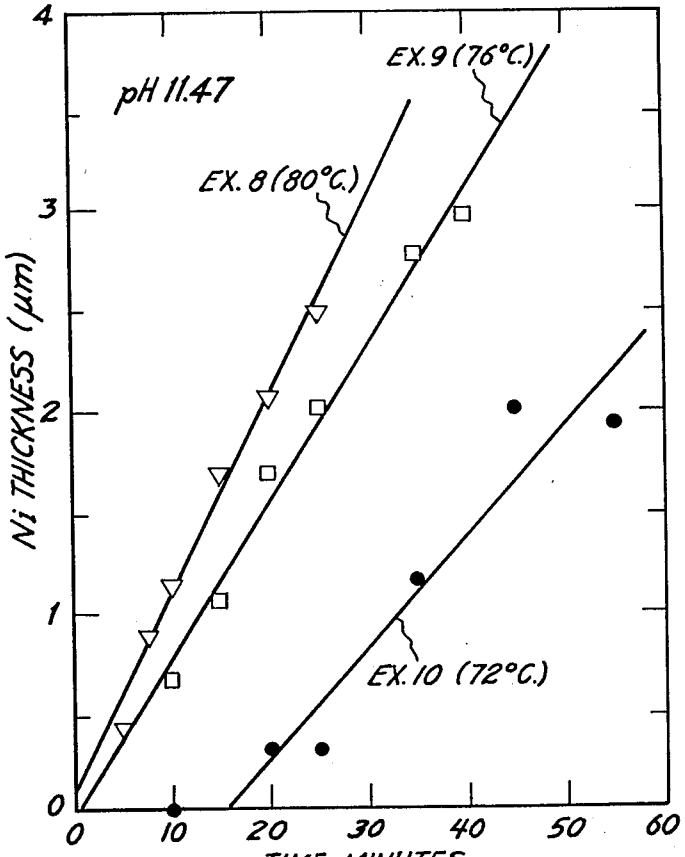
FIG. 2 is a graphical representation of nickel thickness as a function of plating time in an electroless plating bath maintained at various temperatures wherein the pH is 11.47.

The nickel plating baths of this invention are characterized by the presence of the tris(hydrazine carboxylato-$N^2$,O) nickelate(1−) complex. This complex, which hereinafter may be referred to as the "nickel complex" or by its formula, $Ni(N_2H_3COO)^{-}{}_3$, functions as a source of nickel for plating. Its Chemical Abstracts Compound Registry Number is 51911-36-5. The complex may be preformed and added separately to the plating bath, but is preferably formed, in situ, by the addition to the bath of precursor compounds which react to form the complex.

This nickel complex is described, for example, in two successive articles by A. Braibanti et al., "Tris(hydrazine carboxylato-N,O) Metal (II) Anions in the Solid State and in Solution I. Potassium Salts" and "Tris(hydrazine carboxylato-N,O) Metal (II) Anions in the Solid State and in Solution. II. Spectroscopic and Magnetic Investigation", *Ric. Sci.* 36, 1153–1156 and 1156–60 (1966); *Chemical Abstracts:* Vol. 66, 108869s (1967) and Vol. 67, 58924d (1967), respectively.

The amount of nickel complex present in the plating bath depends on several variables, including the desired plating rates and thicknesses, as well as the chemical and physical characteristics of the substrate being plated, e.g., the degree to which the substrate surface has been activated. The bath contains at least about 0.01 mole of nickel complex per liter of solution, and substantially all of the nickel (i.e., substantially greater than 99%) is present in the form of the complex. Since higher levels of the nickel complex often result in higher plating rates, preferred embodiments of this invention call for at least about 0.1 mole of the complex per liter of bath solution.

The plating bath of this invention employs hydrazine as the reducing agent for the nickel complex. Hydrazine may be added to the bath in the form of hydrazine itself or as a hydrazine hydrate. The hydrazine, i.e., that which is in addition to the hydrazine forming a part of the nickel complex, is present in an amount sufficient to reduce substantially all of the complex to nickel metal on a substrate surface. The molar amount of hydrazine reducing agent should be at least equal to the molar amount of nickel present in the bath, as further described in the examples which follow.

The bath should have a pH in the range of about 10 to about 13, and more preferably, in the range of about 11 to about 12. The most preferable range is about 11.4 to about 11.8. In general, a higher pH results in higher plating rates, but also tends to lower bath stability.

Furthermore, preferred embodiments of this invention include buffering the pH. The buffer replaces $OH^-$ ions which are consumed in the plating reaction, thereby serving to maintain a relatively constant deposition rate durig plating. Several buffers are suitable for maintaining the pH in the above-described range. One of these is a mixture of phosphate salts, e.g., dibasic potassium phosphate ($K_2HPO_4$) and tribasic potassium phosphate ($K_3PO_4$). Another suitable buffer is a mixture of phosphate and hydroxide salts, e.g., a mixture of $K_2HPO_4$ and KOH. The required level of buffer may easily be determined by monitoring the bath pH. The examples which follow describe exemplary quantities of buffer used in specific plating compositions.

A suitable temperature range for the bath during plating is about 70° C. to about 80° C., although bath temperatures as low as about 60° C. and as high as about 90° C. are also possible. When plating onto unactivated refractory surfaces, an especially preferred bath temperature is about 75° C. to 80° C., as shown in the examples which follow.

The electroless plating bath of the present invention may be prepared in several ways. For example, the nickel complex may be preformed and added in the form of a salt to a quantity of water prior to addition of the other ingredients; or the salt of the complex could be later added to an aqueous solution containing the other ingredients. An example of a salt useful for this technique is the potassium salt of the complex. The amount of nickel in the complex would be used to determine the required amounts of the other ingredients which are discussed below.

In preferred embodiments of the present invention, the nickel complex is formed in situ by reacting aqueous hydrazine carboxylate with a nickel salt to form a solution containing the complex, free hydrazine, and free hydrazine carboxylate. Hydrazine carboxylate, discussed further below, is a potent complexing agent for nickelous ion. The preferred nickel salt is nickel acetate, although nickel chloride and nickel nitrate are also suitable. If sodium, rather than potassium, is the cationic species in the bath (as described below), nickel sulfate or nickel perchlorate are suitable sources of nickel because sodium sulfate and sodium perchlorate are highly soluble in water, but potassium sulfate and potassium perchlorate are not. The nickel salt may be dissolved separately in water and then added to a solution containing the hydrazine carboxylate.

The hydrazine carboxylate may be formed by reacting stoichiometric portions of bicarbonate and hydrazine. Potassium bicarbonate is preferred, although sodium bicarbonate and lithium bicarbonate might also be suitable. The preferred preparation technique employs potassium bicarbonate and hydrazine hydrate as reactants. The particular required amount of these materials depends on plating conditions and nickel quantity, and falls within the guidelines outlined below and further illustrated in the examples which follow.

Hydrazine carboxylate is advantageously present in the bath in an amount sufficient to stabilize the nickel complex, i.e., to substantially prevent its decomposition. The appropriate amount of hydrazine carboxylate may be calculated from Equation (1) and the corresponding equilibrium constant $K_1$:

$$3N_2H_3COO^-(aq) + Ni^{+2}(aq) \rightleftharpoons Ni(N_2H_3COO)_3^-(aq) \quad (1)$$

$$K_1 = \frac{[Ni(N_2H_3COO)_3^-]}{[N_2H_3COO^-]^3\,[NI^{+2}]}$$

The equilibrium constant $K_1$ is very large, greater than $10^{14}$, for the plating temperatures contemplated here. Those skilled in the art understand that if hydrazine carboxylate is present in excess, then substantially all of the $Ni^{+2}$ is held in solution as the nickel complex. Thus, the particular amount of hydrazine carboxylate which will prevent decomposition of the nickel complex may be calculated for a given set of conditions without undue experimentation. In general, at least about 4 moles of hydrazine carboxylate per mole of nickel is sufficient.

In preferred embodiments, a carbonate compound is also added to the plating composition in an amount sufficient to stabilize the hydrazine carboxylate, i.e., to substantially prevent its decomposition. Suitable carbonate compounds include sodium carbonate, lithium carbonate or, most preferably, potassium carbonate. The carbonate should be added to a mixture containing the hydrazine carboxylate prior to the addition of the nickel salt.

The appropriate amount of carbonate may be calculated from Equation (2) and the corresponding equilibrium constant $K_2$:

$$N_2H_4(aq) + CO_3^{-2}(aq) \rightleftharpoons N_2H_3COO^-(aq) + OH^- \quad (2)$$

$$K_2 = \frac{[N_2H_3COO^-]\,[OH^-]}{[N_2H_4]\,[CO_3^{-2}]}$$

The equilibrium constant $K_2$ has a value of approximately $10^{-2}$ for the plating temperatures contemplated herein. It is evident that for a particular hydroxyl ion concentration, the amount of carbonate which will prevent the spontaneous decomposition of the hydrazine carboxylate may be readily calculated. Generally, approximately 0.4 mol/L to 0.6 mol/L of carbonate should be present in a plating bath which operates at a temperature of about 70° C.–80° C. and a pH of about 11.4 to 11.8. Those skilled in the art understand that according to the equilibrium expression $K_2$, a change made in the concentration of one species must be compensated for by a change in the concentration of another species, since $K_2$ is constant at any given temperature.

Further details and exemplary preparations of these baths are provided in the examples below.

The plating bath contains at least one cationic species in an amount sufficient to neutralize the negative charges of the anionic species in the bath, such as the carbonate and hydrazine carboxylate anions. The cationic species is added to the bath in the form of a salt of one of the other components, e.g., a carbonate or bicarbonate salt. Illustrative cationic species include potassium, sodium, and lithium. Potassium salts are generally preferred for the present invention because of their relatively high solubility in the plating bath. Thus, the bath might very well contain potassium in the form of potassium carbonate ($K_2CO_3$), potassium bicarbonate ($KHCO_3$), potassium hydroxide (KOH), and the like.

As further described below, the use of the nickel complex in combination with the other ingredients in the present composition allows high plating rates and good quality deposition of nickel on both activated and unactivated metal substrates. Furthermore, the plating bath is extremely stable. In order to characterize this stability, it should first be noted that fine metal particles form spontaneously at some finite rate in all electroless plating baths. Because these particles are catalytic sites on which further metal deposition will actively take place, they will eventually cause decomposition of the bath as all of the metal therein is plated onto the particles. In other electroless nickel plating baths known in the art in which hydrazine is used as the reducing agent, the rate of formation of these fine particles is very fast, and bath decomposition is complete in less than about 24 hours at operating temperatures. In the present bath, the rate of formation of these fine particles is much slower, and the bath may be operated for periods of four months or longer if the particles formed in it are periodically removed, e.g., by filtering the bath about once every 24 to 48 hours. Moreover, this stability can be maintained without the addition of conventional stabilizing agents such as thiourea or heavy metal compounds. Use of these conventional stabilizing agents is unsatisfactory if pure nickel deposits are required because they also introduce undesirable impurities in the deposit, such as sulfur or lead atoms.

Another embodiment of the present invention is a method of electrolessly applying a layer of nickel to a metal substrate. Substrates which may be plated with nickel according to this method include refractory metals such as tungsten and molybdenum, as well as other metals that are naturally catalytic to such deposition, such as iron, cobalt, copper, rhenium, palladium, platinum, and gold. An important feature of this method is its use in plating nickel on unactivated tungsten or molybdenum, since activation is usually required to promote plating on these metals.

Prior to plating, the substrate surface generally is cleaned by well-known methods, such as the use of a mild soap solution and/or degreaser material, followed by rinsing in deionized water and then drying. Alternatively, a metallized ceramic substrate may be cleaned by heating in hydrogen gas or in gas mixtures containing hydrogen and an inert gas such as argon or nitrogen, for about 30 minutes at about 100° C.

In those instances in which activation of the substrate prior to plating is desired, activation may be accomplished by any suitable method. For example, the substrate may be washed with mild soap in an ultrasonic bath, followed by rinsing and then soaking in deionized water in the ultrasonic bath. The substrate may then be immersed in a solution containing the activator, e.g., a solution of palladium chloride to which has been added sufficient hydrochloride to bring the pH to about 1.7. After the activation treatment, the substrate may be rinsed and then soaked again in deionized water in the ultrasonic bath. Those having ordinary skill in the art appreciate that other activation methods would also be suitable.

In practicing this method, the plating bath described above is contained in a vessel made of a material inert to the plating chemicals, e.g., a vessel of glass or of a plastic such as polyprppylene. The plating bath is heated to maintain the temperature between about 70° C. and 80° C. Stirring of the bath provides both chemical homogeneity and uniform plating solution temperatures. The substrate surface is maintained in motion, e.g., by rotation, to dislodge gas bubbles which can adhere to the substrate surface and decrease the amount of plating composition in contact with the surface, thereby reducing plating efficiency.

Reactants consumed during the deposition of nickel, such as hydrazine, nickel ion, and hydroxyl ion, are replenished from time to time. For example, the hydrazine content may be periodically measured by titration and then restored to its original value by adding more of the hydrazine compound. The nickel ion concentration may be determined by colorimetry or by titration and then restored to its original value by adding more of the nickel salt. Furthermore, the addition of an alkali metal hydroxide such as potassium hydroxide maintains the pH at its original value.

If the appearance of the plated nickel is rough in texture and/or brown in color, the plated substrate may be heat-treated for about 20–40 minutes at approximately 600° C. to about 700° C. in an atmosphere of 10% hydrogen in argon. Such a treatment results in the electroless-plated nickel having a bright, shiny metallic gray appearance.

Plating rates when the presently-described method is employed depend on a variety of factors, including the amount of nickelate hydrazine complex used, pH, plating temperature, and the like. Plating rates as high as 22 microns per hour have been achieved.

As mentioned above, the plating baths of the present invention exhibit a high level of stability whether in use or in storage. For example, many of these bath compositions may be effective in plating nickel for at least about 4 months. This stability is an especially desirable attribute in commercial plating operations wherein parts such as semiconductor chip carriers must be plated in quantity on a continuous production line with very little "downtime".

The scope of the present invention also includes the application of a second layer of nickel or another suitable metal by electroplating techniques, the details of which are known in the art.

EXAMPLES

The following examples are provided to more fully describe the various embodiments of this invention. It is intended that these examples be considered as illustrative of the invention, rather than limiting what is otherwise disclosed and claimed herein.

The following chemical formulae may be used in the examples:

potassium bicarbonate—$KHCO_3$
hydrazine hydrate—$N_2H_4.H_2O$
potassium carbonate—$K_2CO_3$
nickel chloride—$NiCl_2.6H_2O$
potassium phosphate—$K_2HPO_4$
potassium hydroxide—KOH

EXAMPLE 1

This example describes the preparation of a plating bath according to the present invention.

An aqueous solution for the electroless deposition of nickel, having a final volume of 3.0 liters, contained 135.2 grams $KHCO_3$ (0.45 mol/L), 97.7 grams $N_2H_4.H_2O$ (0.65 mol/L), 207.3 grams $K_2CO_3$ (0.50 mol/L), 72.4 grams of 98.4% $NiCl_2.66H_2O$ (0.10 mol/L), 261.3 grams $K_2HPO_4$ (0.50 mol/L), and 48.8 grams KOH (0.25 mol/L).

The $KHCO_3$ and $N_2H_4.H_2O$ were dissolved in about 1 liter of deionized water, and the solution was stirred for about 4 hours at room temperature in order to allow the formation of hydrazine carboxylate. The $K_2CO_3$ was then added to the solution and dissolved in it. The $NiCl_2.6H_2O$ was dissolved separately in about 100 mL water, and this second solution was added to the first solution. The mixture was stirred for approximately 5 minutes. The $K_2HOP_4$ and the KOH were dissolved separately in about 500 mL water with the substantial evolution of heat. This third solution was then cooled to room temperature and added to the first solution. The resulting solution was then diluted to its final volume of 3.0 liters. The pH at room temperature was 11.7.

EXAMPLE 2

This bath was prepared according to the present invention by the use of a mixed nickel salt containing carbonate and hydroxide anions. An aqueous solution having a final volume of about 3.0 liters contained 135.6 grams 99.7% $KHCO_3$ (0.45 mol/L), 97.7 grams $N_2H_4.H_2O$ (0.65 mol/L), 193.6 grams $K_2CO_3$ (0.47 mol/L), 261.3 grams $K_2HPO_4$ (0.50 mol/L), 22.7 grams of 87.2% KOH (0.12 mol/L), and 38.31 grams of basic nickelous carbonate, 46.0% by weight nickel, having an approximate composition: $NiCO_3.2Ni(OH)_2.4H_2O$ (0.10 mol/L Ni).

The $KHCO_3$ and $N_2H_4.H_2O$ were dissolved in about 1.5 liters of deionized water, and the solution was stirred for about 4 hours at room temperature to allow the formation of hydrazine carboxylate. The $K_2CO_3$ was then added to the solution and dissolved therein. The $K_2HPO_4$ and the KOH were dissolved separately in about 500 mL of water with the substantial evolution of heat. This second solution was cooled to room temperature and then added to the first solution. The basic nickelous carbonate solid was then added. The mixture was stirred for about 16 hours at room temperature. The nickelous carbonate solid had dissolved after this time. The mixture was then diluted to its final volume of 3 liters, and exhibited a pH of 11.7.

EXAMPLE 3

In an alternative preparation, the basic nickelous carbonate compound described in Example 2 was first dissolved in an acid, such as aqueous orthophosphoric acid. This procedure shortens the time required for bath preparation as compared to the procedure used in Example 2. An aqueous solution having a final volume of about 3.0 liters contained 135.7 grams $KHCO_3$ (0.45 mol/L), 97.7 grams $N_2H_4.H_2O$ (0.65 mol/L), 207.3 grams $K_2CO_3$ (0.50 mol/L), 86.1 grams of 85.2% (0.25 mol/L), 38.3 grams basic nickelous carbonate, 46.0% by weight nickel, having an approximate composition $NiCO_3.2Ni(OH)_2.4H_2O$ (0.10 mol/L Ni), 130.7 grams $K_2HPO_4$ (0.25 mol/L), and 106.6 grams of 87.2% KOH (0.55 mol/L).

The $KHCO_3$ and $N_2H_4.H_2O$ were dissolved in about 1.0 liter of deionized water, and the solution was stirred for about 60 minutes at room temperature to allow the formation of hydrazine carboxylate. The $K_2CO_3$ was then added to the solution and dissolved in it. The $K_2HPO_4$ and KOH were dissolved separately in about 500 mL of water with the substantial evolution of heat. This second solution was cooled to room temperature and then added to the first solution. A third solution was then prepared which contained the $H_3PO_4$ diluted with about 100 mL of water. The basic nickelous carbonate was added to this third solution, promptly dissolving therein. The third solution was then added dropwise to the first solution. A green precipitate formed transiently as each drop of the third solution struck the first, but this solid material immediately dissolved, yielding a clear blue solution. The solution was then diluted to a final volume of 3.0 liters, and had a pH at room temperature of about 11.6. The total elapsed time in preparing this solution was much shorter than the time required in Example 2.

Examples 4–7 describe methods for plating metal substrates according to the present invention.

EXAMPLE 4

A solution was prepared with a composition described in Example 1, except that the amount of 86% KOH was increased to 58.7 grams (0.30 mol/L). This solution had a pH of 11.7, and was used to deposit nickel onto 24 tungsten-metallized ceramic chip carriers. The chip carrier surfaces were unactivated in any way, except that 59 days previously, they had been heated inhydrogen gas at 1000° C. for 30 minutes to clean them and to reduce oxides on the tungsten surfaces. They had been stored in air at room temperature since that time.

The plating composition was heated to a temperature of about 80° C.±1° and maintained at that temperature. The 24 parts were tumble barrel-plated in the bath with a Sterling Systems miniature tumble barrel. Nickel plating commenced immediately upon immersion of the parts in the solution, as was evident from the immediate appearance of vigorous bubbling as nitrogen gas evolved. The plating process Was interrupted at elapsed times of 2.5, 5, 7.5. 10, and 12.5 minutes, with 4 parts being removed from the barrel on each occasion. The plating of the remaining 4 parts was stopped at 15 minutes. Visual inspection showed that nickel was plated on each part uniformly over all tungsten surfaces and nowhere else. The parts were then rinsed in deionized water and dried.

Nickel thicknesses were measured by X-ray fluorescence. The mean and standard deviation for each set of 4 chip carriers at each plating time is shown in Table 1 below:

TABLE 1

| Plating Time (min.) | Ni Thickness (microns) |
|---|---|
| 2.5 | 0.44 ± 0.06 |
| 5.0 | 1.01 ± 0.06 |
| 7.5 | 1.44 ± 0.03 |
| 10.0 | 1.88 ± 0.11 |
| 12.5 | 2.38 ± 0.09 |
| 15.0 | 2.70 ± 0.08. |

These values are also plotted in FIG. 1, which will be described below.

EXAMPLE 5

The temperature of the bath in Example 4 was reduced to 76°±1° C., and the experiment was repeated with slightly different plating times. Again, as in Example 4, nickel deposition commenced immediately. The following results were obtained:

TABLE 2

| Plating Time (min.) | Ni Thickness (microns) |
|---|---|
| 2.5 | 0.21 ± 0.08 |
| 5.0 | 0.69 ± 0.06 |
| 7.5 | 0.93 ± 0.03 |
| 10.0 | 1.41 ± 0.13 |
| 15.0 | 2.03 ± 0.09 |
| 20.0 | 2.68 ± 0.08. |

Figure 1:
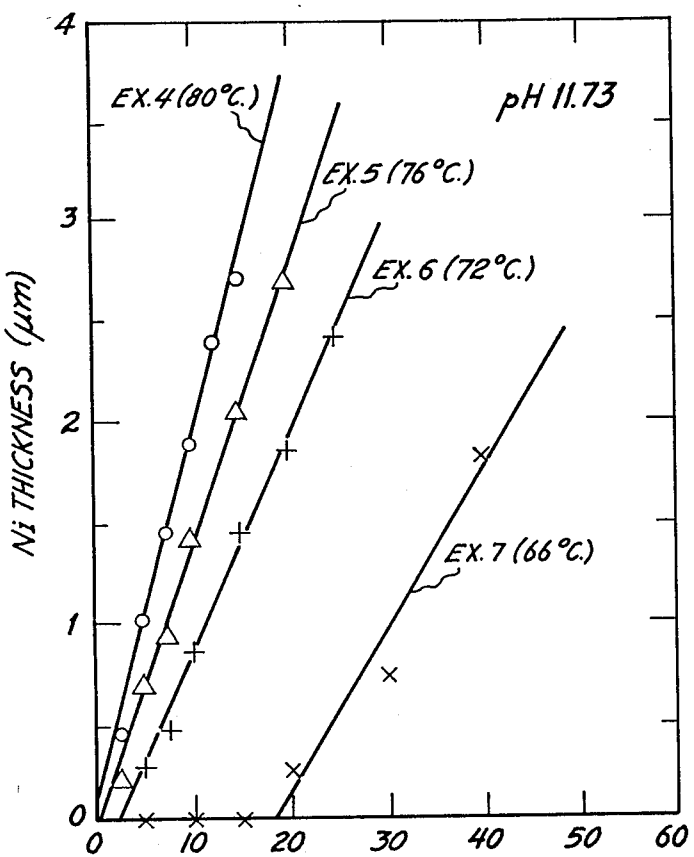
FIG. 1 is a graphical representation of nickel thickness as a function of plating time in an electroless plating bath maintained at various temperatures, wherein the pH is 11.73.

These values are also plotted in FIG. 1.

EXAMPLE 6

The temperature of the bath in Example 4 was reduced to 72°±1° C., and the experiment was repeated (with slightly different plating times). Nickel deposition appeared to commence only after several minutes. The following results were obtained:

TABLE 3

| Plating Time (min.) | Ni Thickness (microns) |
|---|---|
| 5.0 | 0.27 ± 0.04 |
| 7.5 | 0.45 ± 0.12 |
| 10.0 | 0.84 ± 0.06 |
| 15.0 | 1.44 ± 0.15 |
| 20.0 | 1.84 ± 0.08 |
| 25.0 | 2.40 ± 0.05. |

These values are also plotted in FIG. 1.

EXAMPLE 7

The temperature of the bath used in Example 4 was reduced to 66°±1° C., and the experiment was repeated again. Nickel deposition did not begin for about 18 minutes. The following values were obtained:

TABLE 4

| Plating Time (min.) | Ni Thickness (microns) |
|---|---|
| 5.0 | 0.00 ± 0.04 |
| 10.0 | 0.00 ± 0.03 |
| 15.0 | 0.00 ± 0.03 |
| 20.0 | 0.24 ± 0.23 |
| 30.0 | 0.72 ± 0.47 |
| 40.0 | 1.91 ± 0.22. |

These values are also plotted in FIG. 1.

FIG. 1, which plots values obtained from Examples 4–7, demonstrates that the plating of nickel on unactivated tungsten substrates may be achieved at a variety of temperatures. At lower temperatures, e.g., 66° C., there was a noticeable time lag before deposition began. However, at 80° C., plating began immediately.

In Examples 8–11, a plating bath identical to that of Examples 4–7 was employed, except that the pH was decreased by decreasing the amount of KOH used.

EXAMPLE 8

A solution was prepared as described above for Examples 4–7, except that the amount of 86% KOH added was decreased to 39.1 grams (0.20 mol/L). The pH of this solution was 11.5 at room temperature. The bath was heated to and maintained at a temperature of 80°±1° C., and plating was carried out as in the previous examples with the following results:

TABLE 5

| Plating Time (min.) | Ni Thickness (microns) |
|---|---|
| 5.0 | 0.42 ± 0.16 |
| 7.5 | 0.89 ± 0.04 |
| 10.0 | 1.14 ± 0.12 |
| 15.0 | 1.70 ± 0.06 |
| 20.0 | 2.07 ± 0.07 |
| 25.0 | 2.11 ± 0.66. |

These results are plotted in FIG. 2.

EXAMPLE 9

The temperature in the bath of Example 8 was reduced to 76°±1° C., and the experiment was repeated, with results as shown in Table 6:

TABLE 6

| Plating Time (min.) | Ni Thickness (microns) |
|---|---|
| 10.0 | 0.67 ± 0.08 |
| 15.0 | 1.07 ± 0.11 |
| 20.0 | 1.71 ± 0.12 |
| 25.0 | 2.03 ± 0.07 |
| 35.0 | 2.79 ± 0.07 |
| 40.0 | 2.99 ± 0.26. |

These values are also plotted in FIG. 2.

EXAMPLE 10

The temperature in the bath of Examples 8 and 9 was reduced to 72°±1° C., and the experiment was repeated. Results are shown in Table 7:

TABLE 7

| Plating Time (min.) | Ni Thickness (microns) |
|---|---|
| 10.0 | 0.00 ± 0.09 |
| 20.0 | 0.32 ± 0.14 |
| 25.0 | 0.32 ± 0.30 |
| 35.0 | 1.18 ± 0.64 |
| 45.0 | 2.03 ± 0.18 |
| 55.0 | 2.06 ± 1.13. |

These values are also plotted in FIG. 2.

FIG. 2 depicts the effect of decreasing the pH of the plating bath. As in FIG. 1, the deposition rate generally increased with increasing temperature. Furthermore, a comparison with FIG. 1 demonstrates that higher plating rates are also achieved by raising the pH of the bath.

The data shown in FIGS. 1 and 2 also demonstrates that a time lag which occurs when plating at lower temperatures is not present at the higher temperatures, i.e., at or above 76° C.

If plating at the lower temperatures is desired, activation of the surface prior to plating by well-known methods, e.g., use of palladium chloride, would eliminate the time lag.

EXAMPLE 11

This examples demonstrates that a plating bath operated under the conditions described above deposits nickel on tungsten-plated chip carriers even when the tungsten surface has not previously been heat-treated in hydrogen gas.

A plating bath having a composition as in Example 1 was prepared. Its pH at room temperature was 11.6. The bath was heated to and maintained at 75°±1° C. 100 ceramic chip carriers of the type described in previous examples were used. However, these chip carriers were not heattreated in hydrogen gas beforehand. After about 60 minutes, the carriers were removed from the solution and visually examined. There was no sign of nickel deposition. After another 15 minutes of immersion, they were again removed and examined. Sporadic nickel deposition was observed. After another 30 minutes of immersion, the chip carriers were again removed and examined. Nickel deposition was present everywhere on every tungsten-metallized region of each chip carrier. The nickel thickness on 40 carriers selected at random was about 1.8±0.5 microns. Since substantially all of this nickel accumulated during the last 30 minutes of immersion, the rate of nickel deposition, once begun, apparently was greater than about 3.5 microns/hour, a rate comparable to those in the previous examples.

While the invention has been described with respect to preferred embodiments, it will be apparent to those of ordinary skill in the art that certain modifications may be made without departing from the spirit and scope of the invention and, therefore, it is intended that the foregoing disclosure be limited only by the appended claims.

What is claimed is:

1. An aqueous bath for the electroless plating of nickel, comprising tris(hydrazine carboxylato-$N^2$,O) nickelate(1−) complex and an amount of hydrazine sufficient to reduce substantially all of said complex to nickel metal on a substrate surface, wherein said bath has a pH of about 10 to about 13.

2. The bath of claim 1 further comprising hydrazine carboxylate and carbonate.

3. The bath of claim 2 wherein hydrazine carboxylate is present in an amount sufficient to stabilize the tris(hydrazine carboxylate-$N^2$,O) nickelate(1−) complex, and carbonate is present in an amount sufficient to stabilize the hydrazine carboxylate.

4. The bath of claim 3 comprising at least about 0.1 mole of said complex per liter of solution.

5. The bath of claim 4 wherein the pH is about 11.4–11.8.

6. The bath of claim 5 further comprising a phosphate salt mixture as a buffer.

7. The bath of claim 5 further comprising a mixture of phosphate and hydroxide salts as a buffer.

8. A method for the electroless deposition of nickel which comprises immersion of a metal substrate into an aqueous plating bath comprising the tris(hydrazine carboxylate-$N^2$,O) nickelate complex and hydrazine, said bath having a pH of about 10 to about 13.

9. The method of claim 8 wherein the bath further comprises hydrazine carboxylate and carbonate.

10. A method according to claim S wherein the substrate metal is selected from the group consisting of tungsten and molybdenum and is nonactivated prior to the electroless deposition.

11. The method of claim 8 wherein the bath contains at least about 0.1 mole of said complex per liter of solution.

12. The method of claim 11 wherein the pH is maintained at about 11.4–11.8.

13. The method of claim 12 wherein the bath temperature is about 70° C. to about 80° C.

14. A method of preparing an electroless plating bath for applying a layer of nickel to a metal surface, comprising:

reacting aqueous hydrazine carboxylate with a nickel salt to form a solution comprising tris(hydrazine carboxylato-$N^2$,O) nickelate(1−) complex, free hydrazine, and free hydrazine carboxylate.

15. The method of claim 14 wherein the hydrazine carboxylate is formed by reacting potassium bicarbonate with hydrazine hydrate, said hydrazine carboxylate stabilized by the addition of a carbonate compound.

16. The method of claim 14 wherein the nickel salt is nickel acetate.

17. The method of claim 14 wherein the bath is maintained at a pH of about 10 to about 13.

18. A method of preparing a plating bath for the electroless deposition of nickel on a metal surface, comprising dissolving hydrazine and a salt of tris(hydrazine carboxylato-$N^2$,O) nickelate(1−) complex in an aqueous medium.

19. The method of claim 18 wherein the bath also contains hydrazine carboxylate and carbonate, and is maintained at a pH of about 10 to 13 by the use of a buffer.

20. The method of claim 19 wherein the buffer is a mixture of phosphate salts.

* * * * *